US006574897B1

(12) United States Patent
Timmer

(10) Patent No.: US 6,574,897 B1
(45) Date of Patent: Jun. 10, 2003

(54) DISPLAY FRAME ASSEMBLY AND METHOD OF USE

(76) Inventor: Dana W. Timmer, Wattmanngasse #10, Vienna (AT)

( * ) Notice: Subject to any disclaimer, the term of this patent is extended or adjusted under 35 U.S.C. 154(b) by 0 days.

(21) Appl. No.: 09/442,543

(22) Filed: Nov. 18, 1999

Related U.S. Application Data

(60) Provisional application No. 60/137,603, filed on Jun. 3, 1999.

(51) Int. Cl.[7] ..... A47G 1/06

(52) U.S. Cl. ..... 40/800; 40/743; 40/777

(58) Field of Search ..... 40/711, 160, 714, 40/725, 743, 771, 776, 781, 777, 800; 428/13

(56) References Cited

U.S. PATENT DOCUMENTS

| | | | | | |
|---|---|---|---|---|---|
| 367,899 | A | | 8/1887 | Ecker | |
| 785,573 | A | * | 3/1905 | Ringo | 40/661 X |
| 912,329 | A | | 2/1909 | Sterrick | |
| 1,338,441 | A | | 4/1920 | Haley | |
| 2,312,007 | A | * | 2/1943 | Thrasher | 40/800 |
| D137,475 | S | | 3/1944 | Morehead | |
| 2,521,558 | A | | 9/1950 | Alvarez | |
| 2,840,228 | A | * | 6/1958 | Takacs | 40/800 X |
| 3,686,894 | A | * | 8/1972 | Handler et al. | 63/19 |
| 3,787,992 | A | * | 1/1974 | Leonhardt | 40/768 X |
| 4,040,724 | A | | 8/1977 | Klingler | |
| 4,353,327 | A | * | 10/1982 | Shroyer | 40/725 X |
| 4,850,125 | A | * | 7/1989 | Green | 40/737 |
| 5,197,213 | A | * | 3/1993 | Borden | 40/737 |
| 5,316,376 | A | * | 5/1994 | Defreitas | 40/587 X |
| 5,666,750 | A | * | 9/1997 | Segan et al. | 40/410 |
| 5,783,005 | A | * | 7/1998 | Handler | 156/63 |
| 5,813,099 | A | * | 9/1998 | Stewart | 40/725 X |
| 5,983,541 | A | * | 11/1999 | Shih | 40/410 |
| 6,025,040 | A | * | 2/2000 | Brockley | 40/800 X |
| 6,158,828 | A | * | 12/2000 | Vacovsky et al. | 312/114 |
| 6,293,038 | B1 | * | 9/2001 | Chang | 40/743 X |

FOREIGN PATENT DOCUMENTS

| | | | | |
|---|---|---|---|---|
| DE | 295 01 171 U | | 3/1995 | |
| FR | 1 250 672 A | | 1/1961 | |
| GB | 745599 | * | 2/1956 | 40/160 |
| JP | 10113263 | | 11/1996 | |
| WO | WO 98 55982 A | | 12/1998 | |

* cited by examiner

*Primary Examiner*—Brian K. Green
(74) *Attorney, Agent, or Firm*—Leo F. Costello

(57) ABSTRACT

A picture frame assembly for enhancing the display of a picture and other viewable objects in a display frame and to a method of framing the picture and objects. The assembly includes a housing having a back wall, an annular side wall projecting from the back wall, a front opening circumscribed by the side wall; a two-dimensional background scene mounted within the housing adjacent to the back thereof; a two-dimensional picture mounted within the housing in front of and in viewing association the background scene; a three-dimensional motif mounted within the housing in front of and in viewing association with both the scene and the picture, the motif and the background scene suggesting a theme related to the picture; and a magnifying lens mounted in the opening of the housing and providing a common field of view for the scene, the picture and the motif.

40 Claims, 5 Drawing Sheets

DISPLAY FRAME ASSEMBLY AND METHOD OF USE

This application claims benefit of provisional application Ser. No. 60/137,603 filed Jun. 3, 1999.

FIELD OF THE INVENTION

The present invention pertains to a display frame assembly and more particularly to a frame assembly that enhances the display of a picture or photograph and other viewable objects in a display frame and to a method of framing the picture and objects.

BACKGROUND

Two-dimensional photographs are typically displayed in a frame covered by a pane of glass perhaps non-reflective but otherwise plain glass. This well-known arrangement presents the picture, as is, with no variations, background, related items, magnification, or other enhancement. Moreover, since the picture is two-dimensional, the display in such a common frame is entirely two-dimensional. Such a frame is the norm and the most commonly used display for photographs in everyday use.

There are situations, however, where the possibility of enhancing a photograph may be appealing. Such situations may include displaying pictures for unique vacation experiences; for certain anniversaries, birthdays, and other celebrations; for novel gifts; and the like. It may be desirable to provide special effects to the photograph by providing a related background or a selected motif suggesting a scene, experience or event related to the photograph, all within a common composite and preferably magnified field of view. Moreover, for maximum utility, a user should have the ability to readily change the items in the frame depending on the user's particular artistic desires at any given time.

Such pictorial enhancement has not previously been known insofar as applicant is aware. Examples of what is known include the decorative frame border disclosed in the United States Borden U.S. Pat. No. 5,197,213. The Borden frame provides a transparent annular cavity that surrounds the picture and that is intended to contain decorative items such as flowers. Although the Borden frame has its own inherent appeal, it does not bring the picture enhancements into close association with the picture. That is, the picture and the enhancement are separately viewed rather than being placed in a composite where they are within the same field of view and appear to be in the same scene. Moreover, the picture frames in the United States patents to Sterrick U.S. Pat. No. 912,329, Morehead, Des. U.S. Pat. No. 137,475, and Alvarez U.S. Pat. No. 2,521,558, all provide enhancements around a central picture but, like Borden, do not bring these enhancements into the same field of view as the picture. Moreover, none of these prior frames is constructed so as to facilitate the selection and placement of various combinations of pictures and enhancements, thereby to allow the user easily to change the mix of pictures and enhancements within a common frame.

SUMMARY

A picture frame assembly is provided that enhances the display of viewable objects in a common field of view within a picture frame. The assembly includes a housing having a compartment that has an opening in the front; a magnifying lens covering the opening and defining a field of view into the compartment; a two-dimensional background scene in the compartment viewable through the lens; a two-dimensional picture, photograph or other principle item to be displayed mounted in the compartment in front of the background scene and thus also viewable through the lens; and at least one three-dimensional motif or object in the compartment between the picture and the lens and thus also viewable through the lens whereby the scene, the picture and the motif appear as a magnified composite view through the lens and may be insertable into or removable from the compartment through the opening.

An object of the present invention is to enhance a two-dimensional picture, photograph or other object to be displayed as seen in a picture frame.

Another object is to provide a picture frame assembly that enhances the display of a two-dimensional picture by providing both a two-dimensional background scene and a three-dimensional motif, all of which are viewable as a composite in a single field of view.

A further object is to provide a picture-enhancing frame assembly in which the picture as well as the enhancements can be readily changed.

Yet another object is to provide a picture frame assembly for enhancing a two-dimensional photo that may be a stand-alone display; an attachment to a magnetic surface, such as a refrigerator door; a locket for a necklace; or the like.

Still another object is to provide a novel picture frame assembly that allows a two-dimensional photograph to be displayed along with a motif, and perhaps a two-dimensional background scene, each of which may suggest the location, occasion, event, or some other relationship to the subject of the photograph.

An additional object is to provide a picture frame assembly as a novelty that can be sold in gift shops associated with special vacation destinations, such as the Washington Monument, Eiffel Tower, Disneyland and the like, wherein a motif of the destination is incorporated into the assembly as a three-dimensional enhancement to a photograph therein.

A still further object is to provide a display frame that mixes two-dimensional and three-dimensional objects within the same field of view behind a magnifying lens that imparts a magnified three-dimensional effect to the entire scene including both the two-dimensional as well as the three-dimensional objects.

These and other objects, features and advantages of the present invention will become apparent upon reference to the following description, accompanying drawings, and appended claims.

DETAILED DESCRIPTION

Figure 2:
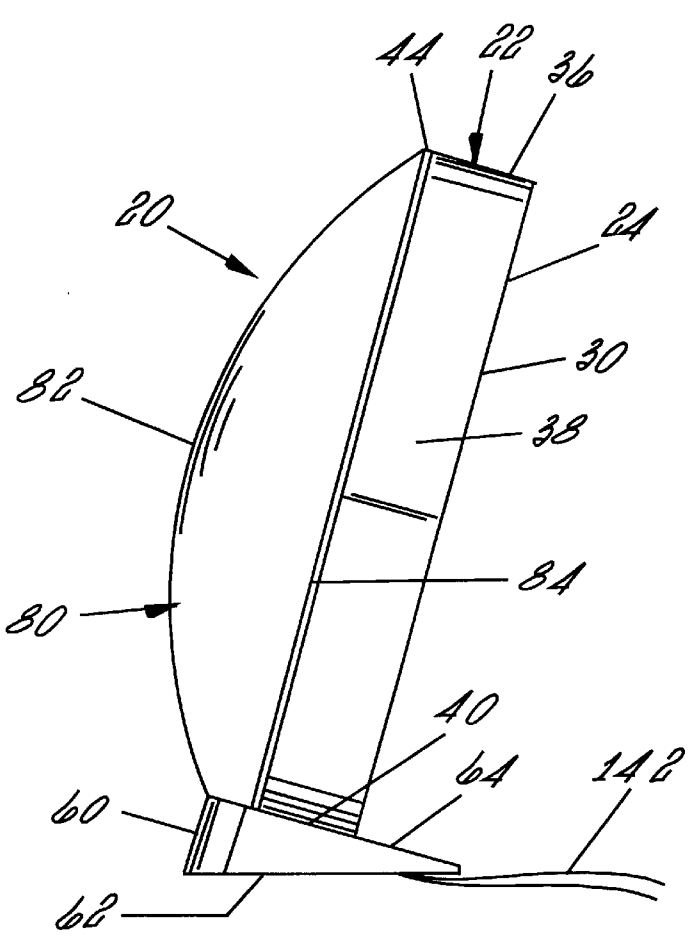
FIG. 2 is a side elevation of the picture frame assembly shown in FIG. 1 and showing an embodiment of the design of the assembly from one side thereof.
Figure 1:
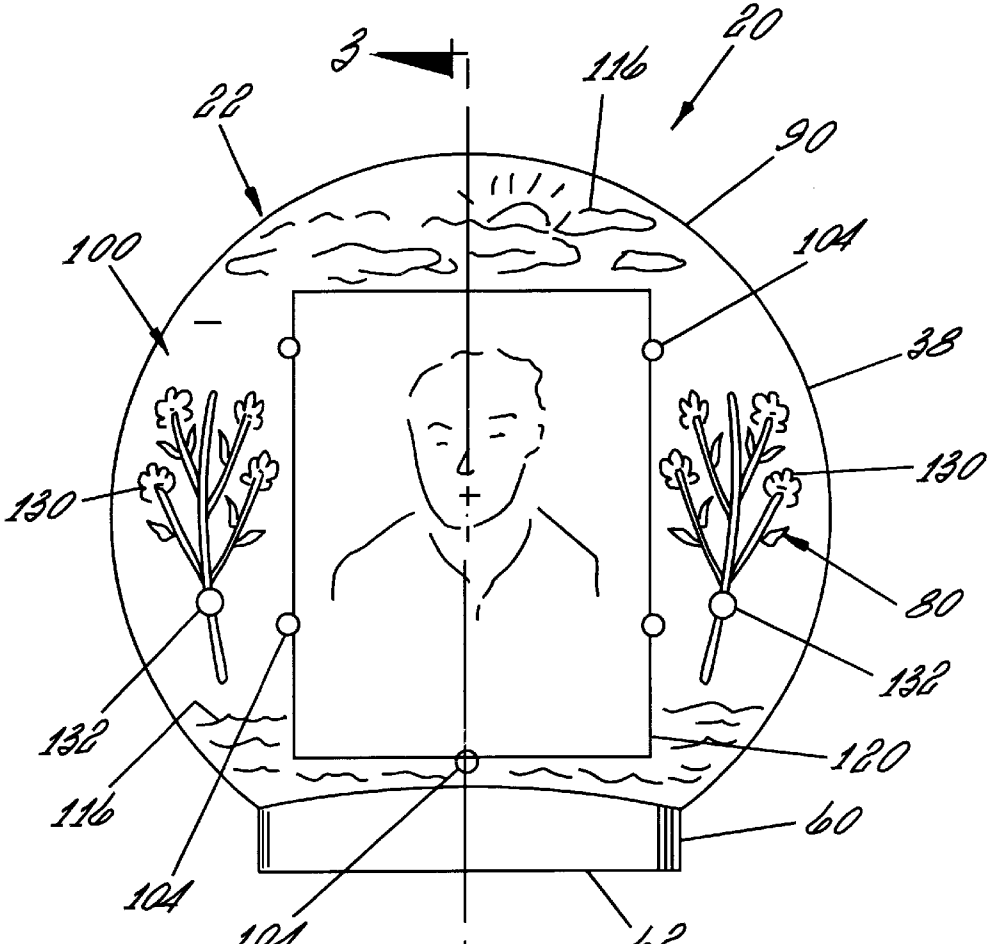
FIG. 1 is a front elevation of a stand-alone, picture frame assembly incorporating the principles of the present invention and showing one embodiment of a motif used in the assembly and showing an embodiment of the design of the assembly from the front thereof.
Figure 3:
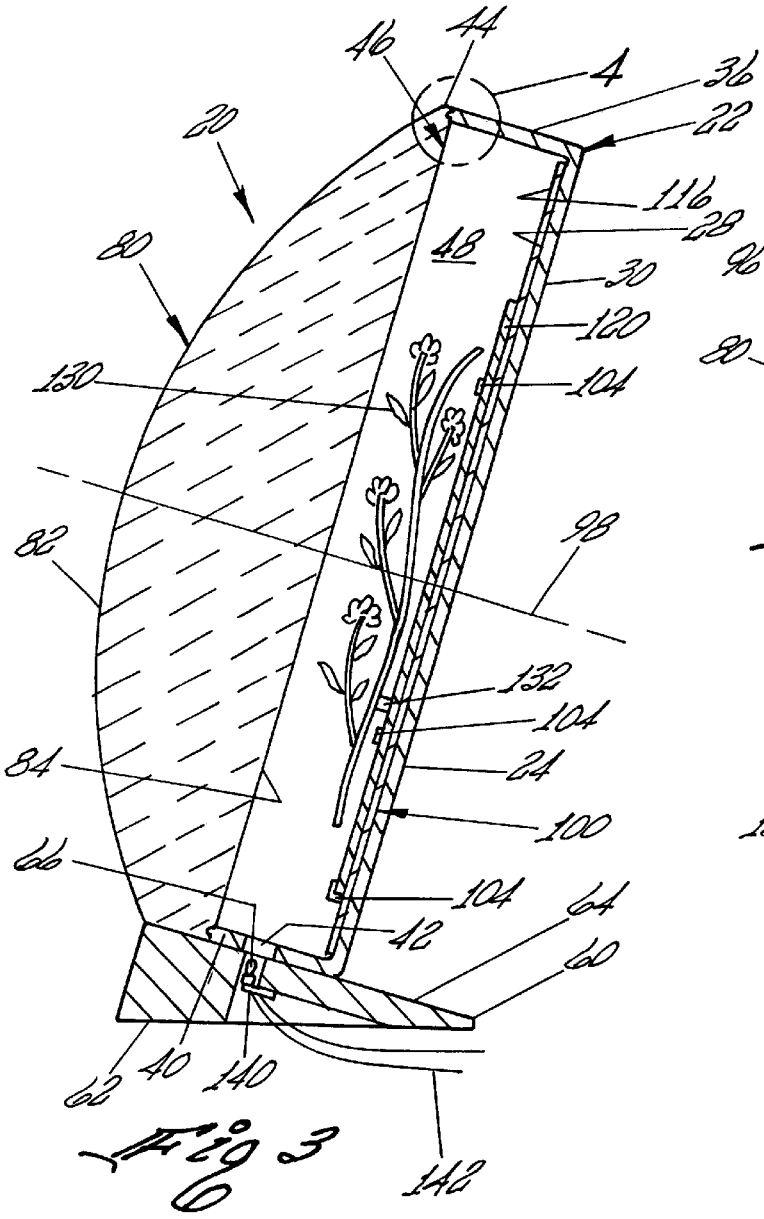
FIG. 3 is an enlarged section taken on line 3—3 in FIG. 1.

A stand-alone embodiment of a picture frame assembly constructed in accordance with the principles of the present invention is generally identified by the numeral 20 in FIGS. 1, 2 and 3. The assembly includes a housing 22, preferably made of a hard, lightweight plastic, although other materials, such as composites, metal, or wood, may be used. The housing and thus the assembly may be of various shapes and sizes, for example, circular, rectangular, or otherwise, but is of generally circular shape in the disclosed embodiment. Again, the size is optional, and basically three sizes are disclosed herein, namely, a relatively large size in FIGS. 1 through 3, a medium size in FIGS. 10 through 12, and a small size in FIGS. 13 and 14, but the invention is not limited to any particular size.

Figure 4:
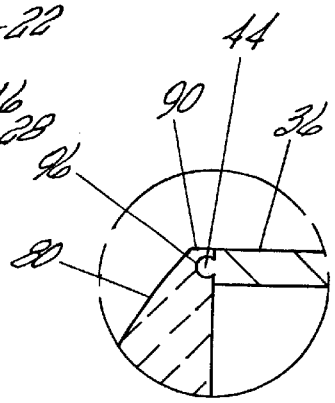
FIG. 4 is an enlarged detail of a tongue and groove construction as may be used for a releasable connection between the housing and the lens of the frame assembly shown in FIGS. 1–3.
Figure 5:
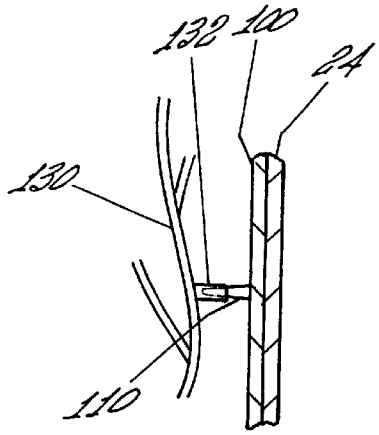
FIG. 5 is an enlarged detail of a motif mount as may be used in the frame assembly shown in FIGS. 1–3.

The housing 22 (FIGS. 1–-3) of the illustrated embodiment thus includes a generally circular, back wall 24, which is preferably opaque but may be transparent, having a lower straight edge segment but otherwise having an upper circular edge, a flat front surface 28 and a flat rear surface 30. The housing thus also has an annular side wall 36, again preferably opaque but possibly transparent, projecting forwardly from the back wall. The side wall has an upper segment that matches the upper edge of the back wall 24 is thus a circular segment in the illustrated embodiment but also has a bottom 40 that is flat, matching the lower edge 26 of the back wall. The bottom of the side wall provides a light aperture 42 used in the illumination of the assembly as will be described. As shown in FIGS. 3 and 4, the side wall has a front annular bead or tongue 44 that circumscribes an opening 46 into a compartment 48 that is defined by the back and side walls.

The stand-alone embodiment 20 of the picture frame assembly (FIGS. 1, 2, and 3) also includes a base 60 that is preferably triangular in side elevation and has a flat lower wall 62 and an inclined upper wall 64, the latter being secured to the bottom 40 of the side wall 36 of the housing 22. The upper wall has a light aperture 66 congruent with the light aperture 42. The base thus allows the picture frame assembly to stand up by itself with the lower wall of the base resting on a flat surface, such as a shelf, table or other piece of furniture.

Figures 9A, 9B:
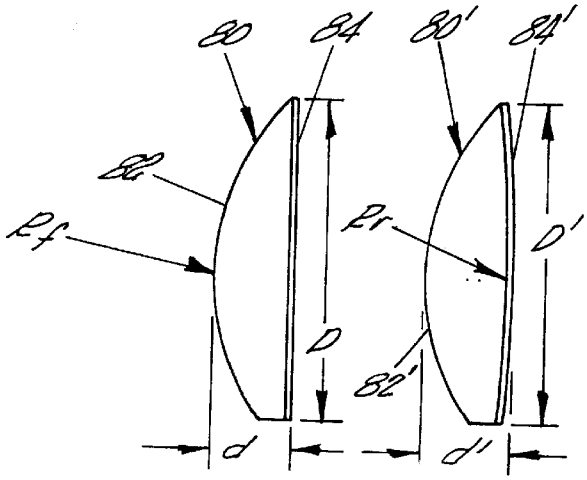
FIG. 9*a* is a side elevation of the lens shown in FIG. 8.
FIG. 9*b* is a side elevation of a modified lens that can be used in the present invention.

The subject picture frame assembly 20 (FIGS. 1–3 and 7–9*b*) also includes a magnifying lens 80 preferably molded or cast out of a suitable acrylic plastic, but alternatively of glass. The lens may have a front convex surface 82 and a rear flat or convex surface 84 or 84', as shown in FIGS. 9*a* and 9*b*, respectively. The lens also has a peripheral edge 90 having an upper circular segment 93 and a straight bottom segment 94 that respectively match the upper and bottom segments 38 and 40 of the side wall 36 of the housing 22. The tear edge of the lens (FIGS. 3 and 4) has a rearwardly facing annular groove 96.

As noted above, the lens 80 (FIGS. 1–3 and 7–9*b*) may be constructed in several different ways such as a convex-flat, as shown in FIG. 9*a*, convex-convex as shown in FIG. 9*b*, or in other ways. The lens dimensions may be varied to create desired effects, and the convex surface 82 or 84' may be either spherical or aspherical. The use of an aspherical shape is well-known to prevent slight distortions such as barrel distortion. The subject invention is not limited to any particular dimensions, but if a convex-flat lens is employed for the larger embodiment of FIGS. 1–3, the diameter D of the lens may be about 8.66 inches to match the larger housing 22, the depth dimension d may preferably be about 1.88 inches and the radius $R_f$ of the front surface 82 may preferably be about 6.10 inches. If a convex/convex lens 80' (FIG. 9*b*) is used for the medium size embodiment of FIGS. 10 through 12, the diameter D' may be about 4.92 inches, the depth d may preferably be about 1.18 inches, the front radius $R_f$ may preferably be about 3.46 inches, and the rear radius $R_r$ may preferably be about 31.496 inches.

The lens 80 (FIG. 3) may be removably attached to the housing 22 by fitting the groove 96 in the lens over the bead or tongue 44 of the housing and then pressing the lens against the housing so as to snap-fit and thereby secure the lens on the housing. Because the materials of housing and lens are of suitable plastics and the tongue and groove are suitably sized, the tongue and groove easily accommodate such a releasable snap-fit relationship. The housing and the lens are thus of the same shape and when fitted together, they have a common axis 98 extending through the center of the lens and the compartment 48 and being circumscribed by the side wall 36 of the housing.

Although as previously stated, the invention is not limited to any particular dimensions, the stand-alone embodiment of the assembly as shown in FIGS. 1–3 may use a housing 22 wherein the side wall may have a maximum diameter of about 8.66 inches, the housing may have a depth from the tongue 44 to the back wall 24 of about 1.35 to 1.5 inches, the diameter D of the lens 80 may be about 8.66 inches the maximum depth d of the lens may be about 1.88 inches, and the angle of the base 60 between the plane of the: lower wall 62 and the back wall 24 may be about seventy-five degrees. These dimensions are not critical, but they have been found to provide a desirable field of view and viewing angle when the picture frame assembly is standing or situated on a table or other similar elevated flat support surface. With these dimensions, the lens provides a magnification of about 1.3 times the actual size of any object within the compartment 48.

As is well known, the power of any lens depends on its focal length, the index of refraction of the lens, and its radius, and the magnification depends upon the distance between the lens and the object being magnified. The principles of lenses and magnification are not part of the subject invention, however, since these are well known. Thus, other lens designs may be employed if a different degree of magnification is desired or if it is desired to create other effects in viewing the interior of the compartment through the lens.

The particular size of the larger embodiment of the picture frame assembly 20 (FIGS. 1–3) has been selected since it creates the desired effects as described herein and because it is sufficiently compact for purchase at a gift shop at a tourist destination and for carrying home in luggage. The principles of the present invention are, however, equally applicable for larger sizes and, as will be specifically seen hereinafter, for smaller sizes.

Figure 7:
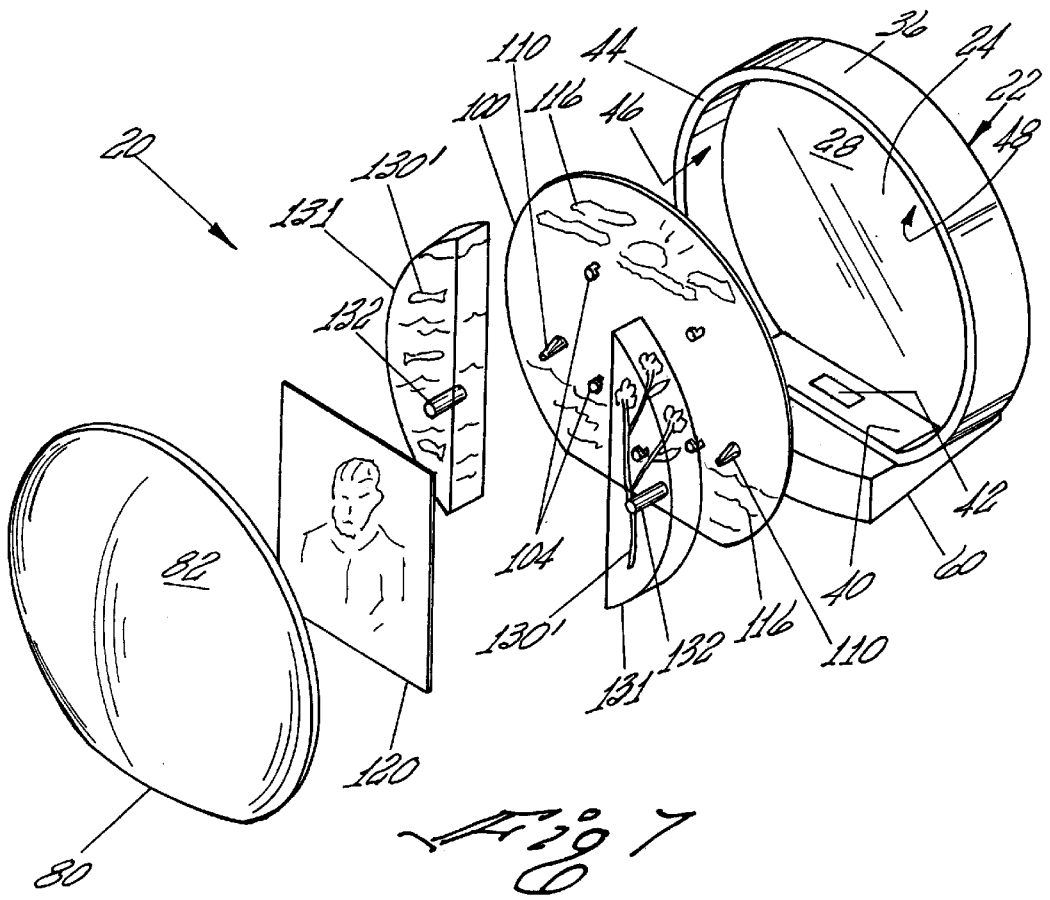
FIG. 7 is an exploded view, on a somewhat smaller scale than FIGS. 1–3, of the frame assembly shown in FIGS. 1–3, but showing another embodiment of the motifs and the manner of displaying them.
Figure 8:
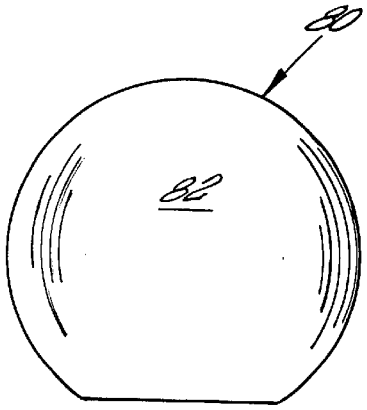
FIG. 8 is a front elevation of the lens shown in FIG. 7.

The picture frame assembly 20 (FIGS. 1, 3 and 7) also includes a mounting panel 100 panel which, in the embodiment of FIG. 7, is made of a thin opaque sheet of stiff plastic or cardboard, again preferably opaque but not necessarily so, and has the general shape of the back wall 24 of the housing. The mounting panel has a back surface that fits flat against the back wall 24 of the housing and a front surface facing the lens 80 and in rearwardly spaced relation thereto. The mounting panel may be of a diametrical size slightly larger than the diameter of the side wall so as to press-fit against the back wall. Alternatively, light adhesives or other fastening methods may be used to releasably retain the mounting panel against the back wall. With the larger embodiment having the dimensions described above, therefore, this front surface may be approximately 1.5 inches from the rear surface 84 of the lens, a useful relationship but not limiting to the present invention.

Figure 6:
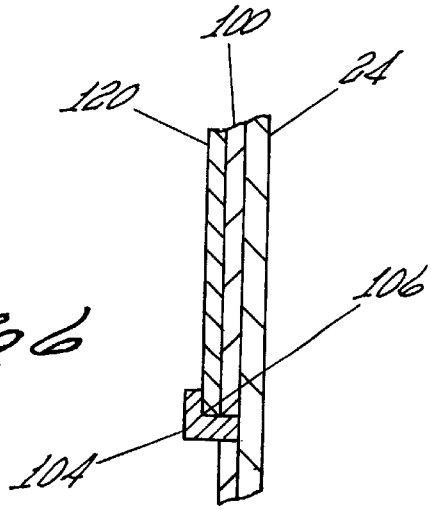
FIG. 6 is an enlarged detail of a picture mount as may be used in the frame assembly of FIGS. 1–3.

A plurality (five as shown) of picture mounting brackets 104 (FIGS. 1, 3, and 6) are attached to the front surface of the mounting panel 100. Two side brackets are attached on each side of the vertical axis of the mounting panel, and a bottom bracket is attached along the vertical axis adjacent to the straight bottom edge of the mounting panel and equidistant between the side brackets. These brackets are preferably made of plastic and are right-angular so as to form slots 106 (FIG. 6) with the panel. The mounting panel also has frusto-conical, motif mounting pegs 110, preferably two in the illustrated embodiment, located on opposite sides of the mounting panel slightly outwardly of the side picture mounting brackets, and for a purpose to be described.

The mounting panel 100 (FIGS. 1, 3 and 7) serves not only a mounting function but also may provide a two-dimensional background scene generally indicated by the number 116 in the figures. This scene may be selected from a wide variety of possibilities such as blue sky with white clouds and sun, an ocean scene with waves, trees, fall foliage, a cityscape, a sporting field, autographed signatures, or a famous writing such as the Declaration of Independence, to mention only a very few of the possibilities. Alternatively, the mounting panel may be left blank, or the background scene may be merely a selected color or colors, or some other artistic scheme or design, or even a mirror. The scene may be imprinted on the panel when the later is made or appliques containing particular scenes may be provided and applied to the front surface by the user. Of course, it is possible to apply a different scene over an old scene and thereby reuse the same mounting panel for different scenes.

The picture frame assembly 20 (FIGS. 1, 3 and 7) also includes a two-dimensional, preferably rectangular picture or photograph 120, which may be the central element of interest in the display. This picture may be the typical snapshot taken by a candid camera, or a more professional photograph. Moreover, although the subject invention is especially suited for enhancing a photograph of people, the principles of the invention are not limited to using the picture of people as the element 120. Other objects may be displayed and featured in the subject frame assembly. These objects may include, for example, a memorable wedding invitation, a poem, a testimonial, a commendation, or an autograph(s) of a celebrity(ies), to name a very few. For description convenience herein, however, this central element is simply referred to as a picture, it being understood such terminology characterizes other possible displays such as those just mentioned. In any event, the picture is supported in the brackets 104 on the mounting panel by inserting the opposite side edges of the picture in the side brackets and resting the lower edge on the bottom bracket. In this manner the picture is located so that its center is approximately on the axis 98 of the lens 80 and the compartment 48.

The picture frame assembly 20 (FIGS. 1–3 and 7) also includes a three-dimensional motif or motifs 130, each of which in the embodiment of FIGS. 1–3 is a replica of a selected object and includes at least one mounting sleeve 132 projecting therefrom and adapted to be press-fit over a mounting peg 110. The motif is preferably a thematic element that may have a desired conceptual relationship to the picture 120. In this regard, if a background scene 116 is used, there may also be a thematic relationship among the picture the background scene, and the motif. The invention is not limited to such a relationship, however, since the subjects of the background scene, the picture, and the motif may be anything within the imagination of the person creating the entire assembly. One example of a motif, as shown in FIGS. 1 and 3, is flowers on a stem to which is attached a rearwardly projecting mounting sleeve 132. However, examples of other possible motifs are miniature replicas of famous strictures, for example, the Eiffel Tower, the Washington Monument, the United States Capitol or Whitehouse: famous characters like Mickey Mouse or Barbie doll; miniatures of a myriad of objects such as sports equipment, including golf clubs and tennis rackets, actor's masks, a chairman's gavel, to mention only a very few possibilities, which are not shown but believed understood. Almost anything conceived by the framer may be used as the motif.

Preferably two motifs 130 are mounted in the compartment 48 on the mounting sleeves 132 releasably fitted over their respective mounting pegs 110 and on opposite sides of the picture 120. As such the mounting sleeves and pegs hold the motif, away from the mounting panel 100 in rearwardly spaced relation to the front opening 46 of the housing 22, as seen in FIG. 3, and in overlying relationship to the background scene 116, as best seen in FIG. 1. Although not shown, in this first embodiment of a motif, part of he motifs may partially overlay the picture; if flowers, for example, some of the petals or branches may extend part way over the picture without obscuring any part of the photograph.

A second embodiment of a motif 130' is shown in FIG. 7. Here, the motif is contained in a transparent, preferably plastic, motif capsule 131 which may have a partial cylindrical shape. The motif capsule can take the form of a wide variety of shapes and configurations and is not limited to the shape shown in FIG. 7. Furthermore, there are preferably a pair of motif capsules adapted to be mounted on opposite sides of the picture 120. For this purpose, each motif capsule has a rearwardly extending mounting peg 132 that is slideably press-fit into one of the motif mounting holes 110 so as to support the motif capsule on the mounting panel and on opposite sides of the picture.

In this second embodiment, each motif 130' itself is contained within its capsule 131 either loosely or supported in some manner. In one of the capsules of FIG. 7, an artificial stem and flowers, like FIGS. 1–3, is the motif and simply sized and fitted in the capsule. In the other capsule, the motif is artificial fish floating in a liquid, such as water, are contained in the capsule. Alternatively, but not shown, the motif, for example, a butterfly or other object, may be embedded in a transparent resin that fills the capsule. Again, the only limit to what the motif in the capsule may be is in the imagination of the artist who in most cases will be the user. In the capsules, the motifs are supported outwardly from the mounting panel 100 in the compartments 48 in rearwardly spaced relation to the rear surface 84 of the lens 80, like in FIG. 3, but now in the capsules. Of course, the motifs overlay the mounting panel and thus overlay the background scene 116 if used.

The subject display frame assembly 20 may utilize a light 140 (FIG. 3) which is conveniently placed in the base 60 beneath the aligned light apertures 42 and 66. An extension cord 142 is connected to the light and extends outwardly from the base for connection to a one-hundred ten volt outlet. When activated, light shines upwardly into the compartment illuminating the background scene 116, the picture 120, and the motifs 130 or 130'. Alternatively, batteries and a switch, not shown, may be housed in the base for energizing the light.

Figure 10:
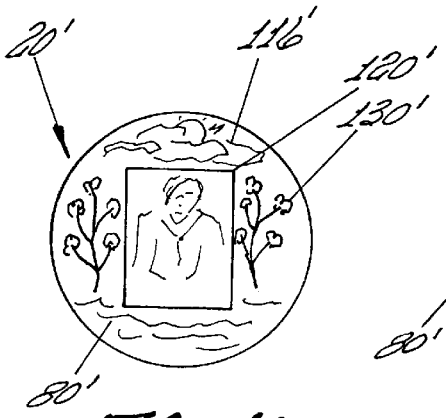
FIG. 10 is a front elevation, on a still smaller scale than FIGS. 7 and 8, of an embodiment of the frame assembly of the subject invention that may be attached to a refrigerator door, or other magnetic surface.
Figure 11:
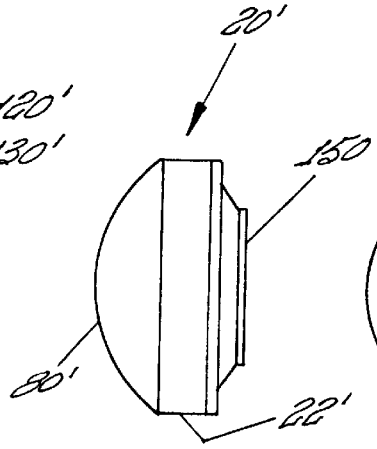
FIG. 11 is side elevation of the frame assembly shown in FIG. 10.
Figure 12:
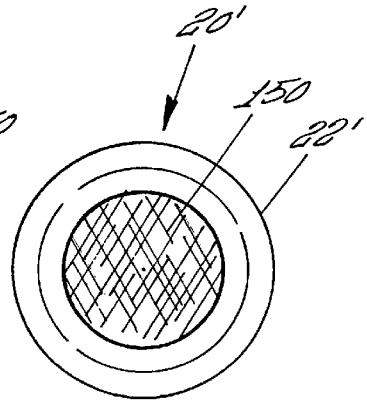
FIG. 12 is a rear elevation of the frame assembly shown in FIG. 10, particularly to show the magnet on the back of the assembly.

With reference to FIGS. 10–12, a second embodiment of the picture frame assembly generally indicated by the numeral 20' is shown. The embodiment illustrated here is smaller than in FIGS. 1 through 3 and is intended for attachment to a refrigerator or other magnetic surface. For this purpose, a magnet 150 is attached to the rear surface of the housing 22'. In other respects, the embodiment 20' incorporates the same features as the stand-alone embodiment 20, and common elements are identified by the same number primed. As an example of the dimensions of a refrigerator-type assembly, the diameter of the housing is about 4.92 inches, the depth of the lens is either about 1.18 inches or about 1.26 inches, depending on whether a spheric or an aspheric lens is used, and the radii $R_f$, $R_r$ are the same as with the larger stand-alone embodiment.

Figure 13:
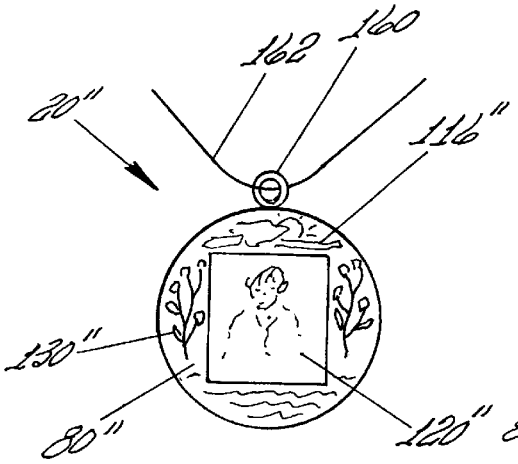
FIG. 13 is a front elevation of yet another embodiment of the frame assembly of the present invention that may be used as a locket on a necklace.
Figure 14:
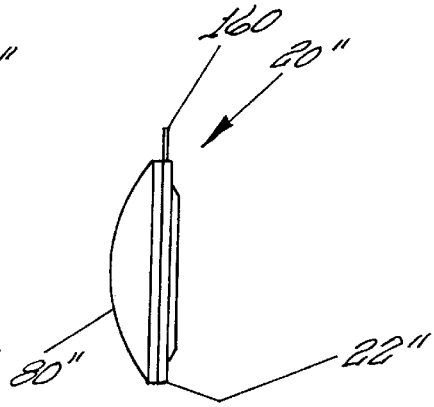
FIG. 14 is a side elevation of the embodiment of the invention shown in FIG. 13.

Still further, a third embodiment of the display frame assembly 20" of the present invention is shown in FIGS. 13 and 14. Here, the picture frame assembly is a locket intended to be used as an item of jewelry. The assembly has an upper eyelet 160 adapted to be connected to a chain 162 that may extend around a user's neck. The locket type of frame assembly may be slightly smaller than the refrigerator-type 20' discussed above. In other respects, the locket frame assembly has the same elements as the stand-alone assembly 20 described above.

Figure 15:
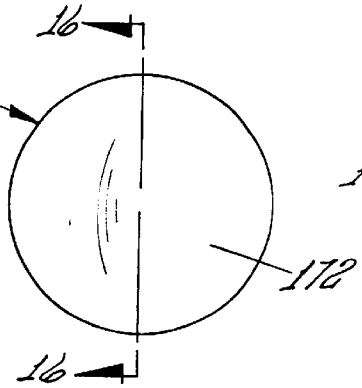
FIG. 15 is a front elevation of a modified lens from that of FIG. 8.
Figure 16:
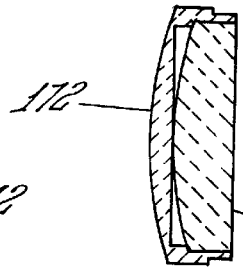
FIG. 16 is a side elevation of the lens shown in FIG. 15.

Another embodiment of lens, a dual or two element lens, is indicated by the number 170 in FIGS. 15 and 16 and includes an inside back lens 171 and an outside front lens 172 snap-fitted over the inside lens. This dual lens may be used because the lens is preferably an injection-molded part that typically can be made up to only ¼ inch thick, not a preferred thickness for the lens of the present invention. In the description of the use of the assembly 20 that follows, it is to understood that the dual lens construction of lens 170 may be employed wherever reference is made to the lens 80.

Figure 17:
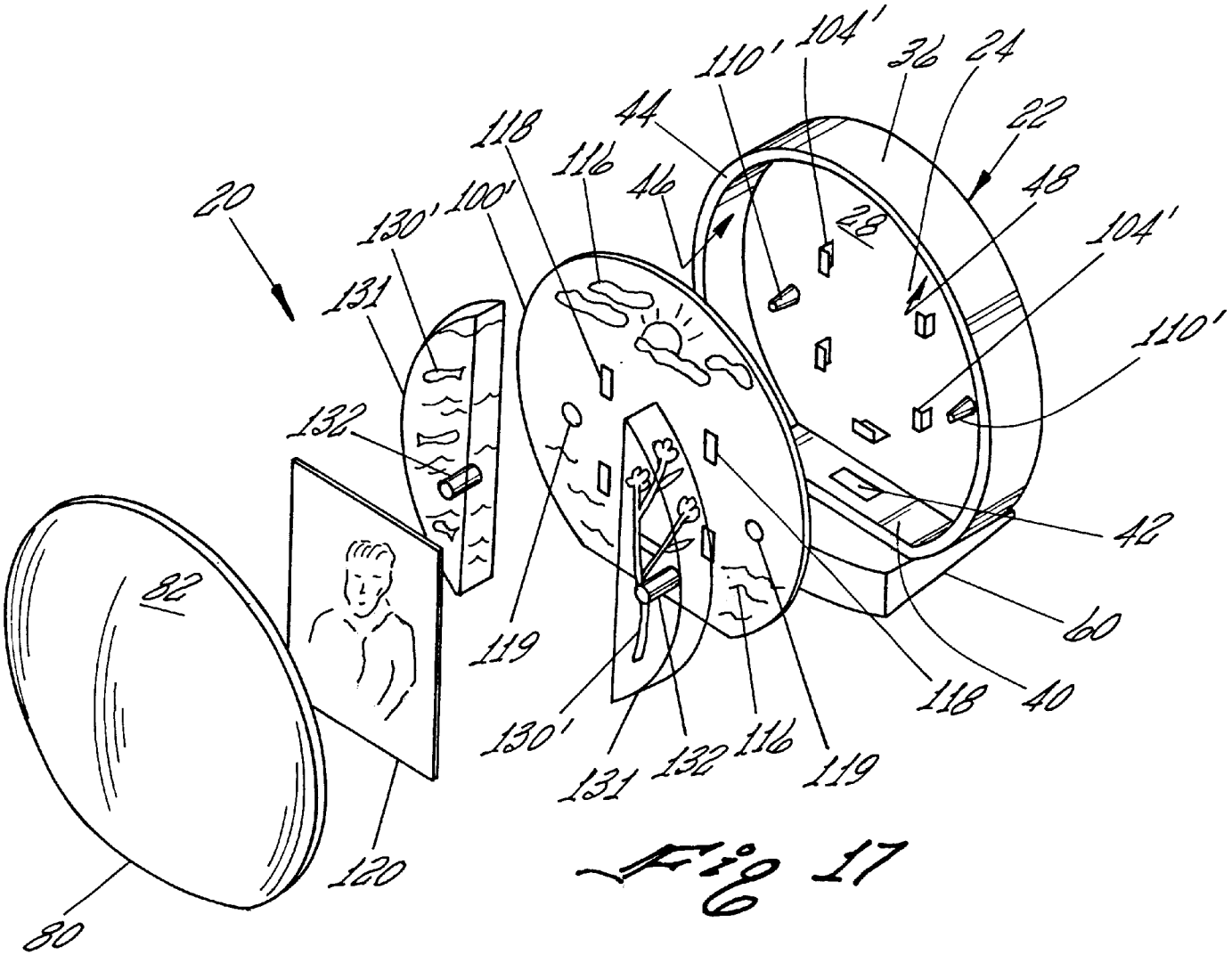
FIG. 17 is a view similar to FIG. 7 but showing a preferred embodiment of the subject picture frame assembly.

FIG. 17 is an exploded isometric view similar to FIG. 7 but showing certain preferred embodiments of various elements of the subject display frame assembly 20. Thus, the preferred mounting panel 100' is a flexible piece of paper, instead of the stiff plastic or cardboard of mounting panel 100. In addition, the brackets 104' and mounting pegs 110' are attached to the back wall 24, and the mounting panel 100' has holes 118 and 119 located therein in the locations of the brackets 104' and mounting pegs 110'. The mounting panel 100' is assembled with the housing by slipping the holes in the panel over their respective brackets and pegs. A suitable adhesive may be applied to the back of the panel 100' and/or the back wall 24, but is not deemed necessary. In other respects, the display frame assembly of FIG. 17 is like the display frame assembly of FIG. 7.

Description of Use and the Method

Although the display frame assembly of the subject invention, whether the embodiments 20, 20' or 20", may be made available through various outlets, these display frame assemblies are ideally suited for gift shops at tourist destinations, for example in the gift shop at the Eiffel Tower in Paris. In reference to FIGS. 1–3 and 7, the display frame assembly 20 may be sold entirely assembled with a replaceable picture 120 in place and with a pre-selected background scene 116 and motif 130 or 130'. All a user need do is to replace the picture with one of his or her own.

Alternatively, a variety of background scenes 116, either on a relatively stiff mounting panel 100 or as an applique therefor, or on a relatively flexible mounting panel 100', or all of these possibilities, and a variety of motifs 130, may be made available for sale along with the assembled display frame 20, 20' or 20" as described. Another option is for the display frame assembly to be sold with only the housing 22 and lens 80 assembled but without the background scene 116, the motif 130, 130' or the picture 120 in the housing. These other elements may be sold separately, or entirely or partially supplied by the user.

In this Eiffel Tower example, the picture 120 might be a photograph of the purchaser in front of the Eiffel Tower or another setting in Paris. A selection of background scenes, perhaps of Paris or its environs, may be made available for sale along with the housing and lens assembly. Also, the motifs might be miniatures of the Eiffel Tower. Thus, along with the photograph taken by the user, the purchaser would procure the basic display frame assembly, including a mounting panel, a selected background scene 116 either as an applique or as a part of the mounting panel, and a pair of miniature Eiffel Tower motifs, either of the first embodiment 130 or in a capsule 131 of the second embodiment.

In such a situation, the purchaser may disassemble the lens 80 from the housing 22 and then assemble the mounting panel 100 or 100', the selected picture 120, and the motifs 130, 130'. As is believed understood, in the preferred embodiment of FIG. 17, the flexible, sheet-like mounting panel is fitted over the brackets 104' and pegs 104' and pressed against the back wall 24, either with or without actual adhesive, so the brackets 104' and pegs 104' extend forwardly from the panel. Alternatively with the embodiment of FIG. 7, the mounting panel 100 is fitted in the housing 22 against the back wall with the brackets 104 and pegs 110 projecting forwardly. In either case, the picture 120 is next inserted in the mounting brackets 104 or 104', and the motifs 130 or 131' are mounted on the pegs 110 or 110'. Lastly, the lens 80 is snapped onto the front of the housing, thereby completing the entire assembly.

With the selected background scene 116, picture 120 and the motifs 130 or 131' within the compartment 48 in the assembled unit 20, the three elements to be displayed are brought together in a unique and integrated manner thereby enhancing the overall effect of viewing the picture. Moreover, the location of the three-dimensional motifs within the compartment on opposite sides of the picture together with the magnification supplied by the lens imparts a three-dimensional effect to all of the objects within the compartment. Furthermore, it will be understood that all of the objects within the compartment, namely the background scene, the picture, and the motifs, are within a common field of view through the lens. This field of view is not only along the axis 98 of the lens but at various angular relationships to this axis either from one side or the other or from above or below the axis. Additionally, the elements within the compartment can be seen from a greater distance because of the magnification provided by the lens.

One of the advantages of the subject display frame assembly 20, 20' and 20" is the ability to personalize the displayed objects or elements and to change these elements at various times and for various situations. The housing 22 and the lens 80 can be readily separated and reattached and the displayed objects can be changed, all as described above. Since various background scenes 116 and motifs 130, 130' may be made available for purchase, or a user may create his or her own background scene and/or motif, a user may employ the same housing for different background scenes, motifs, and pictures 120 so that the subject assembly is highly versatile. Similarly, versatility is achieved in having not only a stand-alone assembly but also the smaller assemblies for display on a magnetic surface or as jewelry.

Although preferred embodiments of the present invention have been shown and described, various modifications, substitutions and equivalents may be used therein without departing from the spirit and scope of the invention. Accordingly, it is to be understood that the present invention has been described by way of illustration and not limitation.

What is claimed is:

1. A display frame assembly, comprising:

a housing having a back wall, a front, a side wall projecting from the back wall and circumscribing an axis of the housing;

a magnifying lens attached to the front of the housing opposite to the back wall and together with the back and side walls defining a compartment in the housing, the lens having an axis collinear with the axis of the side wall and capable of magnifying what is placed in the compartment;

a flat member positioned against the back wall of the housing and having a front surface facing the lens;

two-dimensional background scene elements on the front surface of the flat member, spaced rearwardly from the lens and thus viewable through the lens;

a picture hanger projecting from the flat member adapted to support a picture centrally within the compartment;

a motif hanger projecting from the flat member between the picture hanger and the side wall;

a two-dimensional picture supported by the picture hanger, spaced rearwardly from the lens, and thus viewable through the lens; and a three-dimensional motif having a thematic relationship to the picture and/or the background scene elements and being supported on the motif hanger, the motif being located on one side of the picture, projecting forwardly from the flat member and the picture, in rearwardly spaced relation to the lens and being thus viewable through the lens, whereby the background scene elements, the picture and the motif appear as a three-dimensional composite through the lens.

2. The assembly of claim 1, wherein the picture hangers are right-angled brackets providing U-shaped slots with the panel disposed to releasably receive the picture.

3. The assembly of claim 1, wherein the motif hangers are pegs projecting from the flat members; and wherein there are sleeves on the motifs that releasably fit on the pegs.

4. The assembly of claim 1, wherein the picture hangers and the motif hangers are attached to the back wall of the housing and project forwardly therefrom; and wherein the flat member is a flexible sheet having openings fitted over the hangers.

5. The assembly of claim 1, wherein the flat member is a mounting panel; and wherein the motif hangers and the picture hangers are attached to the panel.

6. The assembly of claim 1, wherein the side wall and the lens have a peripheral interfitting tongue and groove construction enabling the lens to be releasably attached to the housing by a snap-fit between the tongue and groove.

7. The assembly of claim 1, wherein the side wall has a flat bottom; and wherein there is a base having a flat lower surface and an inclined upper surface, said upper surface being attached to the bottom of the side wall whereby the housing can be supported with said axes inclined.

8. The assembly of claim 7, wherein the base has a light aperture communicating with the compartment; and wherein there is a light in the base capable of shining through the aperture upwardly into the compartment.

9. The assembly of claim 1, wherein the lens has a convex front aspheric surface and a flat rear surface.

10. The assembly of claim 1, wherein the lens has a convex front and rear aspheric surfaces.

11. The assembly of claim 1, wherein the back wall has a rear outside surface; and wherein there is a magnet attached to the outside surface of the back wall.

12. The assembly of claim 1, wherein the side wall has a top; and wherein there is an eyelet attached to the top of the side wall.

13. The assembly of claim 1:

wherein the lens, the side wall, and the back wall are all substantially circular and of substantially the same diameter;

wherein the flat member is of sheet material releasably positioned against the back wall;

wherein there are a plurality of picture hangers defining a picture hanging area with a center lying on said axis;

wherein the picture hangers are mounted on the back wall and project into the compartment through the flat member;

wherein there are at least two motif hangers mounted on the back wall and projecting forwardly into the compartment through the flat member on opposite sides of and forwardly of the picture;

wherein there are motifs individually supported on the motif hangers; and wherein the flat member, the picture and the motifs are each separately releasable from the compartment through a common opening in the housing.

14. A frame assembly for enabling a user to display a picture and three-dimensional motif together wherein the picture is a central element of interest in the assembly and the motif is in an offset position relative to the picture and has a memorable association with the picture, comprising:

a housing having a back wall and a front portion, a magnifying lens at the front portion in spaced opposed relation to the back wall, and a side wall joining the back wall and the lens, the back and side walls and the lens defining a compartment in the housing, the lens providing a field of view into the compartment;

spaced picture supporting elements on the back wall collectively defining a picture border around a picture mounting area disposed centrally of said field of view; and a motif-mounting element suspended in the housing in laterally outwardly offset relation to the border and in spaced relation to the back wall, the side wall, and the lens.

15. The assembly of claim 14, wherein there is a background-scene-mounting area on the back wall extending from the border to the side wall and within said field of view.

16. The display fame of claim 15, wherein means for providing a background scene is on the background scene-mounting area.

17. The assembly of claim 14, wherein the motif-mounting element is elongated, is attached to one of the walls, projects into the compartment, and has a terminus that is spaced from the back wall, the lens, the side wall and that is forwardly spaced from said border.

18. The frame assembly of claim 14, wherein the side wall interconnects the back wall and the lens in circumscribing relation to the compartment and to a centerline of the compartment, thereby enclosing the compartment, the lens having an axis collinear with said centerline;

wherein the picture supporting elements are brackets projecting forwardly from the back wall in spaced relation to each other along said border, the picture-mounting area having a center lying on said centerline; and wherein the motif-mounting element is elongated, projects into the compartment from the back wall, and has a terminus in spaced relation to the back wall, the side wall and the lens, and is in laterally and forwardly offset adjacent relation to the border.

19. The display frame of claim 18, wherein a two-dimensional picture is mounted in the brackets in said picture-mounting area.

20. The display frame of claim 18, wherein a three-dimensional motif is mounted on said terminus of the motif-mounting member within said field of view and is spaced from the side and back walls and the lens.

21. The display frame of claim 18, wherein a two dimensional picture is mounted in the brackets;

wherein a three-dimensional motif is suspended in the compartment on said terminus of the motif-mounting member and within said field of view; and wherein means for providing a background scene is on the back outside of said picture-mounting area, whereby the suspended mounting of the motif imparts a three-dimensional effect to the picture, the background-scene providing means, and the motif.

22. A frame assembly for enabling a user to display a picture as a central element of interest in the assembly and a motif wherein the motif has a memorable association with the picture, comprising:

a housing having a back and a front, a magnifying lens at the front in spaced opposed relation to the back, and a side wall joining the back and the lens and defining a compartment in the housing, the lens providing a field of view into the compartment;

means for supporting a picture on the back centrally of said field of view, the picture having a border; and means for suspending a three-dimensional motif at a point in the housing that is within said field of view but is in laterally spaced relation to the border and the side wall and in spaced relation to the back and the lens.

23. A display frame assembly, comprising:

a housing having a back and a front, a magnifying lens at the front in spaced opposed relation to the back, and a side wall joining the back and the lens and defining a compartment in the housing, the lens providing a field of view into the compartment;

a picture supported on the back centrally of said field of view and having a border;

a three-dimensional motif; and a motif mounting member attached to the motif in back thereof and suspending the motif in the housing in said field of view, offset from the border, and in spaced relation to the back, the side wall, and the lens, the motif having a memorable association with the picture.

24. The assembly of claim 23 wherein there is a transparent motif capsule mounted within the housing; and wherein the motif is within the capsule.

25. The assembly of claim 24, wherein there is a supporting medium in the capsule; and wherein the motif is supported in the medium.

26. The assembly of claim 25, wherein the medium is a liquid.

27. The assembly of claim 25, wherein the medium is resin.

28. The assembly of claim 23, wherein there is a background scene on the back within said field of view and between the border and the side wall.

29. A personalized display frame assembly for displaying a picture in association with a motif and a scene of a memorable situation and adapted to be modified by a user, comprising:

a housing having a compartment therein with a front and a back and a side wall joining the front and the back and circumscribing a centerline of the housing that extends from the front to the back;

a magnifying lens on the front of the housing having a field of view into the compartment and an axis substantially collinear with said centerline;

a two-dimensional background scene releasably positioned in the compartment adjacent to said back;

a two-dimensional picture of a person releasably positioned in the compartment adjacent to the scene, in back of the lens, and centered on said centerline; and a three-dimensional motif releasably mounted in the compartment in spaced relation to the side wall, the scene and the lens, offset from the centerline in forwardly adjacent relation to the picture, the background scene, the picture and the motif being in said field of view, the motif and the background scene recalling an experience, event or place related to the person in the picture, the housing having a closeable opening providing user-access to the compartment and of a dimension large enough for each of the background scene, picture, and the motif to pass through into and out of the housing.

30. The personalized display frame assembly of claim 29, wherein there is a two-dimensional background member releasably attached to and overlying the back;

wherein the picture is mounted in overlying relation to the background member centrally of the field of view and has top, bottom and side edges;

wherein the background scene is on the background member and extends from and in circumscribing relation to the picture outwardly to the side wall and within said field of view; and wherein there are a plurality of three-dimensional motifs releasably mounted in the compartment in forwardly laterally adjacent relation to edges of the picture and spaced from the back and side walls and the lens.

31. The personalized display frame assembly of claim 29, wherein there are elongated mounting pegs having first attachments connected to the back and second attachments individually connected to the motifs; and wherein one of the first and second attachments is releasable.

32. The personalized display frame assembly of claim 29, wherein there are elongated mounting pegs individually interconnecting the back and the motifs; and wherein the motifs overlie and substantially conceal their pegs as seen through the lens.

33. A frame assembly, comprising:

a housing having a compartment therein with a front and a back and a side wall joining the front and the back;

a magnifying lens on the front of the housing having a field of view into the compartment;

a picture positioned in overlying relation to the back and generally centered in the field of view;

a background scene element positioned in overlying relation to said back between the picture and the side wall and in the field of view; and a three-dimensional motif positioned in spaced relation to the back, the side wall, and the lens, on one side of the picture, in offset relation to the background scene element, and in the field of view.

34. The frame assembly of claim 33, wherein there is a mounting peg projecting forwardly from the back wall and offset from the background scene element and the picture; and wherein the motif is mounted on the peg.

35. The frame assembly of claim 33, wherein there are a plurality of background scene elements on the back in spaced relation to each other and in the field of view;

wherein the background scene elements are two-dimensional;

wherein there are a plurality of motifs in spaced relation to each on opposite sides of the picture and in the field of view;

wherein the motifs are three-dimensional; and wherein each of the motifs is offset from the background scene elements, whereby each of the background scene elements, each of the motifs, and the picture are individually seen through the lens.

36. The frame assembly of claim 35, wherein there are mounting pegs projecting forwardly from the back wall and offset from the background scene elements and the picture; and wherein the motifs are individually mounted on the pegs.

37. The frame assembly of claim 33, wherein the frame assembly is self-modifiable by the user in that each of the picture, background scene element, and motif is not permanently secured in the housing but is easily removable from and insertable into the housing through an opening in the housing.

38. The frame assembly of claim 33, wherein the picture is of a person;

wherein the background scene element and motif are suggestive of an experience that is memorable to said person.

39. A self-modifiable frame assembly for displaying a two-dimensional picture of a person in association with two-dimensional background elements and three-dimensional motifs recalling a memorable experience for the person, comprising:

a housing having a compartment therein with a front and a back and a side wall joining the front and the back and circumscribing a centerline of the housing that extends from the front to the back;

a magnifying lens on the front of the housing having a field of view into the compartment and an axis substantially collinear with said centerline;

a two-dimensional picture of a person releasably positioned in overlying relation to the back and generally centered in the field of view;

two-dimensional background scene elements releasably positioned in overlying relation to said back, in offset relation to the picture, and in the field of view; and three-dimensional motifs releasably positioned in spaced relation to the back, the side wall, and the lens, on opposite sides of the picture, in offset relation to the background scene elements and in the field of view of view, the background scene elements and the motifs recalling an experience related to the person in the picture, the housing having a closeable opening providing user-access to the compartment and of a dimension large enough for each of the background scene elements, picture, and the motifs to pass through into and out of the housing.

40. A method for creating a personalized composite display of a two-dimensional background, a two-dimensional picture, and a three-dimensional object in a frame assembly having a front and a back with a compartment therebetween, a magnifying lens at the front providing a field of view into the compartment, and a side wall interconnecting the back and the lens and circumscribing the compartment, wherein the picture has a center and is of a person and wherein the background and the object have a memorable association to a particular place, event or experience associated for the person in the picture, comprising the steps of;

mounting the two-dimensional picture of a person on the back centrally of the field of view;

selecting the two-dimensional background having indicia thereon that has a memorable association to a particular place, event, or experience for the person in the picture;

mounting said two-dimensional background on the back around the picture and in the field of view;

selecting the three-dimensional object that has the same memorable association to the person in the picture as the background; and supporting said three-dimensional object in the compartment in the field of view but offset from the center of the picture, in spaced relation to the back, the lens, the side wall, and spaced forwardly of the picture, whereby the picture, the background, and the object appear as a three-dimensional composite through the lens.

* * * * *